US007922410B2

(12) United States Patent
Gueret

(10) Patent No.: US 7,922,410 B2
(45) Date of Patent: Apr. 12, 2011

(54) APPLICATOR AND A PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 756 days.

(21) Appl. No.: 11/356,047

(22) Filed: Feb. 17, 2006

(65) Prior Publication Data

US 2006/0188318 A1 Aug. 24, 2006

Related U.S. Application Data

(60) Provisional application No. 60/658,164, filed on Mar. 4, 2005.

(30) Foreign Application Priority Data

Feb. 18, 2005 (FR) ..... 05 50460

(51) Int. Cl.
*A46B 11/00* (2006.01)

(52) U.S. Cl. ..... 401/129; 401/126

(58) Field of Classification Search ..... 401/4, 5, 401/10, 11, 119, 122, 127, 129, 191, 126
See application file for complete search history.

(56) References Cited

U.S. PATENT DOCUMENTS

| | | | | |
|---|---|---|---|---|
| 4,998,315 | A | 3/1991 | Pessis | |
| 5,357,647 | A | 10/1994 | Gueret | |
| 5,588,447 | A | 12/1996 | Gueret | |
| 5,765,573 | A | 6/1998 | Gueret | |
| 6,033,142 | A | 3/2000 | Gueret | |
| 6,033,143 | A * | 3/2000 | Gueret | 401/129 |
| 6,210,059 | B1 | 4/2001 | Ramin et al. | |
| 6,257,788 | B1 | 7/2001 | Gueret | |
| 6,331,085 | B1 * | 12/2001 | Schrepf et al. | 401/128 |
| 2002/0023658 | A1 * | 2/2002 | Gueret | 132/218 |
| 2004/0096261 | A1 | 5/2004 | Gueret | |

FOREIGN PATENT DOCUMENTS

| | | | |
|---|---|---|---|
| DE | 100 43 930 | A1 | 4/2002 |
| EP | 0 556 081 | A1 | 8/1993 |
| EP | 0 651 955 | A1 | 5/1995 |
| EP | 0 829 211 | A1 | 3/1998 |
| EP | 1 004 255 | A1 | 5/2000 |
| EP | 0 746 992 | B1 | 4/2001 |
| EP | 1 407 685 | A1 | 4/2004 |
| EP | 1 462 023 | A1 | 9/2004 |
| FR | 2 564 712 | | 11/1985 |
| FR | 2 738 127 | | 7/1997 |
| GB | 1 083 891 | | 9/1967 |
| GB | 2 159 699 | A | 12/1985 |

* cited by examiner

*Primary Examiner* — David J Walczak
(74) *Attorney, Agent, or Firm* — Oliff & Berridge, PLC

(57) ABSTRACT

An applicator may include a stem, a closure element configured to close a receptacle, and a bundle of bristles including a cross-section of elongate shape along a major axis thereof. The closure element may be at a first end of the stem. The bundle of bristles may be at a second end of the stem, remote from the first end of the stem. The bundle of bristles may include, as observed perpendicularly to the major axis, a beveled end. An angle at a tip of the bevel may lie in a range of about 10° to about 35°.

27 Claims, 2 Drawing Sheets

Fig.1
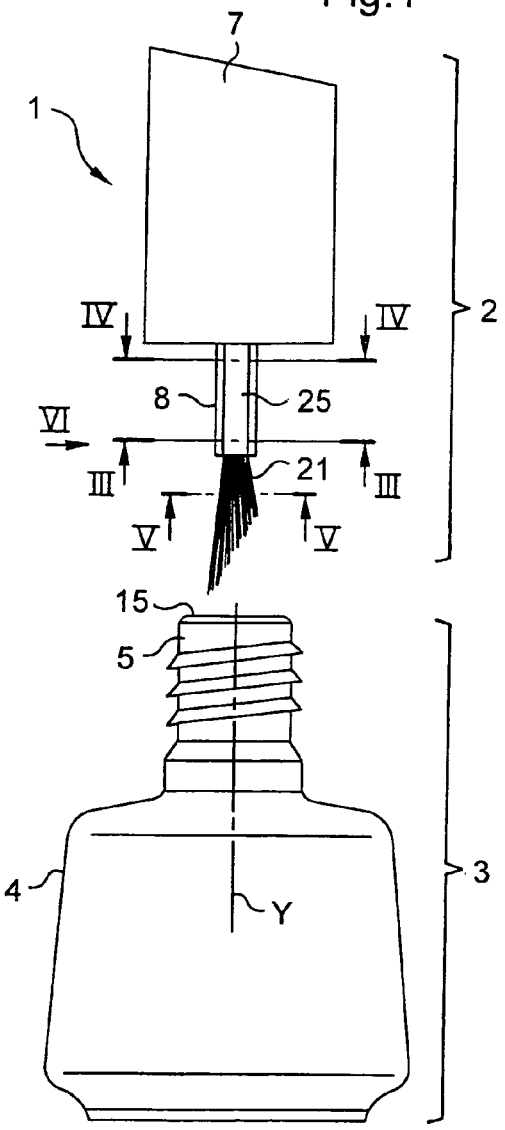
Fig.2
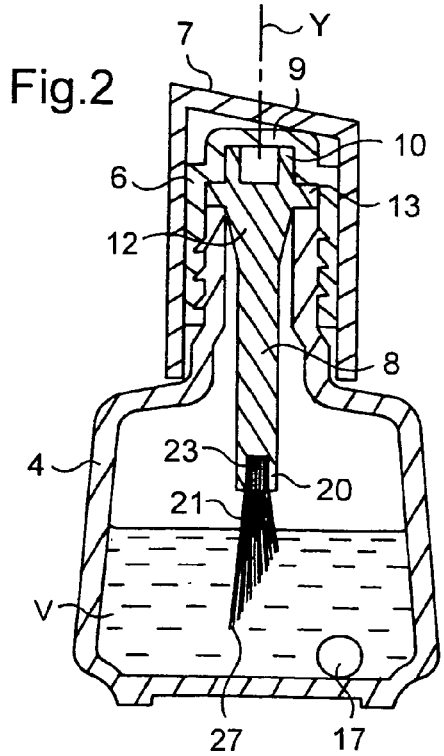
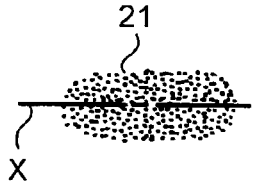
Fig.5
Fig.3
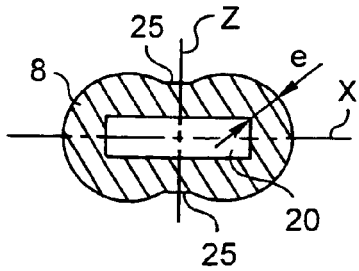
Fig.4
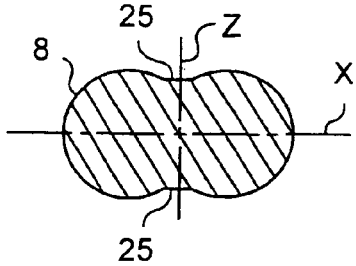
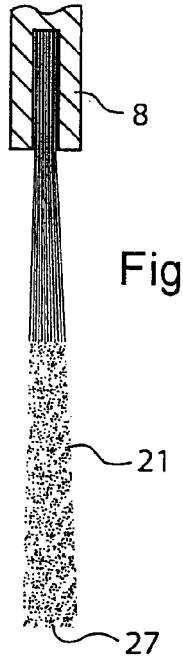
Fig.6

Fig.7
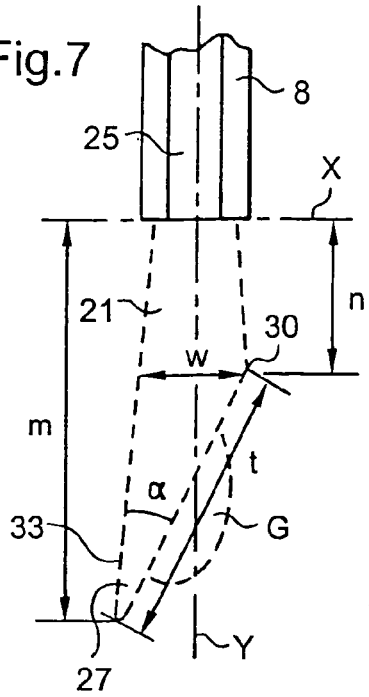
Fig.9
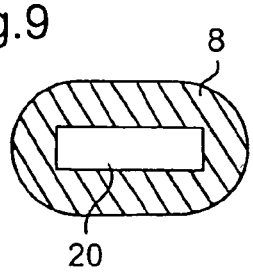
Fig.8
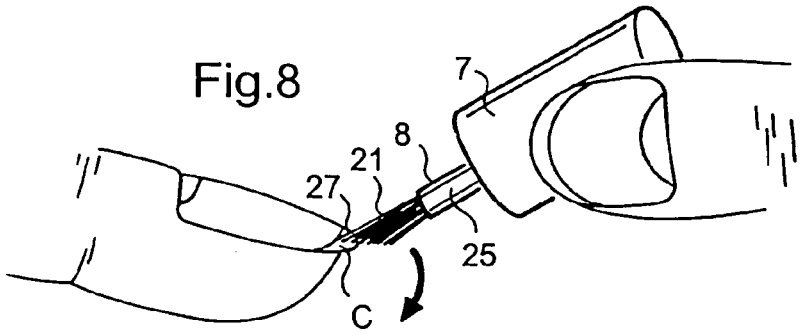
Fig.11
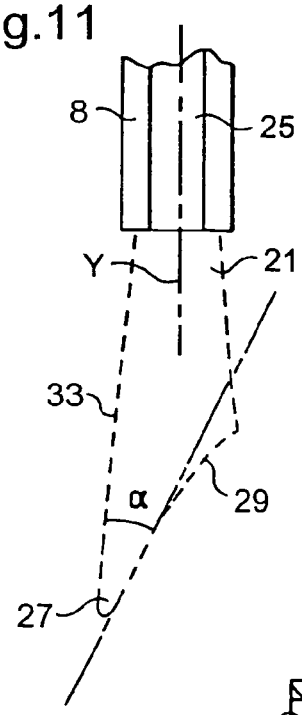
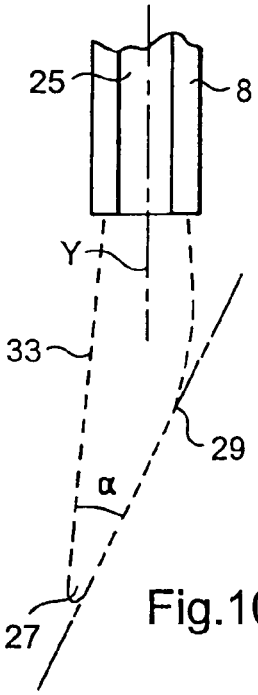
Fig.10
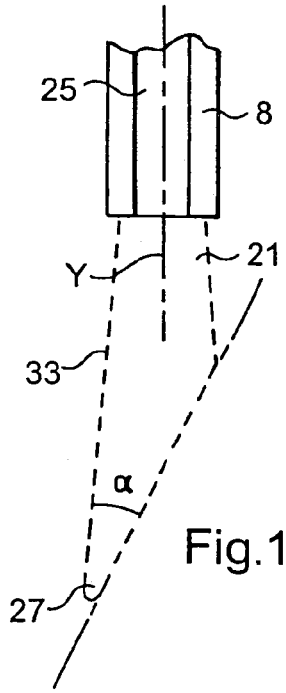
Fig.12
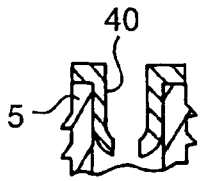
Fig.13

APPLICATOR AND A PACKAGING AND APPLICATOR DEVICE

CROSS-REFERENCE TO RELATED APPLICATIONS

This non-provisional application claims the benefit of French Application No. 0550460 filed on Feb. 18, 2005 and U.S. Provisional Application No. 60/658,164 filed on Mar. 4, 2005, the entire disclosures of which are incorporated herein by reference.

The present invention relates to applying makeup to, and caring for, skin or nails, and more particularly, but not exclusively, to performing a "French manicure," which consists of depositing a white composition on the end of varnished nails to imitate the white of the nails.

BACKGROUND

Felt-tipped applicators generally make it possible to deposit an even line of composition.

Paint-brush type brushes are more suitable for applying pigmented compositions.

European patent applications EP 0 556 081, EP 0 651 955, EP 0 746 992, and EP 1 462 023 describe nail-varnish applicators.

SUMMARY

It is difficult to deposit compositions that are rich in pigments using felt-tipped applicators, given that the pigments become caught in the fibers of the felt.

With known brushes, it is difficult to deposit an even line of composition, since said composition tends to form a drop at the end of the brush.

Brushes of cylindrical or flat section, and having a straight end, present too much composition, and the made-up effect is not entirely satisfactory.

Brushes that are beveled a little at the end are no more suitable, too much composition still flowing to the tip.

Finally, brushes having a central tapered tip certainly present a smaller drop at the end, but the viscosity of the composition often means that the drop is still too thick to obtain a completely satisfactory result.

The applicators of the above-referenced European patent applications are not particularly suitable for depositing an even line of composition.

Exemplary embodiments of the present invention seek to make it easier to perform a "French manicure" using a brush, and more generally, to make it possible to deposit an even line of composition on skin or nails, regardless of whether or not the line is constant.

Exemplary embodiments of the present invention may provide an applicator comprising: a stem; a closure element for closing a receptacle, the closure element being at a first end of the stem; and a bundle of bristles at a second end of the stem, remote from the first end of the stem, the bundle of bristles including a beveled end, an angle at a tip of the bevel lying in a range of 10° to 35°, preferably in a range of 15° to 30°, and better still in a range of 16° to 23°.

In exemplary embodiments, the bundle of bristles may include a cross-section that is elongate along a major axis X thereof, and, when observed perpendicularly to the major axis X, includes the beveled end.

Exemplary embodiments of the present invention may provide, especially given the relatively steep slope of the bevel, a drop of composition that is formed at the end of the brush after wiping the tip, to be sufficiently remote from the tip for the tip to be used without too much composition arriving during application.

Exemplary embodiments of the present invention may make it possible to rupture capillary action at the end of the brush.

Thus, in exemplary embodiments, a user may be able to more easily control a thickness of composition deposited, and a formation of a layer of continuous thickness may be facilitated.

Nevertheless, in exemplary embodiments, composition tending to accumulate at the end of the brush may supply the tip during application, for example, when the bristles are deformed by pressing against the nail or the skin.

In exemplary embodiments, a thickness of the tip of the brush, measured along the axis X, may be less than ⅓ of a maximum width of the bundle of bristles along the axis X, indeed less than ¼ of the maximum width of the bundle of bristles along the axis X.

In cross-section, the bundle of bristles may preferably include a generally flat shape, being of substantially oval- or rectangular-shaped section, for example.

The cross-section of the bundle of bristles may not be circular, for example.

When observed perpendicularly to the major axis X, the bundle of bristles may not have a rim or a step, for example.

In exemplary embodiments, the stem may comprise at least one groove opening substantially mid-way across the bundle of bristles. For example, the at least one groove may comprise a longitudinal groove, which may extend over a major fraction of a length of the stem, for example.

In exemplary embodiments in which the stem comprises such a groove, the composition flowing along the stem may tend to collect preferentially in a central region of the brush, thereby making it possible to reduce even further any risk of too much composition at the tip of said stem.

In exemplary embodiments, the stem may comprise two longitudinal grooves opening substantially mid-way across the bundle of bristles and disposed opposite each other on the stem.

In exemplary embodiments, the stem may comprise a housing including an oblong cross-section, in particular rectangular or oval, in which the bundle of bristles is received, thereby making it easier to form a bundle of generally flat shape.

The stem may include a constant cross-section, for example.

For example, the bundle of bristles may comprise at least one tuft of bristles that is stapled in the housing. The bristles may also be secured other than by stapling, for example, by embedding in the stem, by adhesive, by heat-sealing, or by overmolding.

In exemplary embodiments, the bundle of bristles may advantageously be stiffened before being used for the first time, thereby making it easier, for example, for the applicator to be put into place mechanically on a corresponding receptacle, and/or making it possible to avoid damaging the bristles during handling that takes place before the applicator is mounted on the receptacle.

In exemplary embodiments, the stem may include an endpiece that is used to secure the stem in the closure element. The endpiece may be tubular, for example. The stem may also be connected in some other way to the closure element, for example, by being made integrally, i.e., monolithically, with the closure element.

In exemplary embodiments, the closure element may be arranged to be fastened onto the receptacle by screw-fastening. However, the closure element may be fastened in some other way, for example, by snap-fastening or by friction, or even via an auxiliary holding part.

A wiper may be disposed in the neck of the flask, where appropriate or desired.

The stem may be rigid or flexible, and may optionally include a joint or a region of greater deformability. A rigid stem may contribute to improving the accuracy with which makeup is applied.

In exemplary embodiments, the tip of the brush may be laterally offset relative to a longitudinal axis of the stem.

A visible length of the bristles may lie in a range of 10 millimeters (mm) to 20 mm, for example.

The bristles may be tapered by disk trimming, for example.

For example, the bristles used may include a section of diameter lying in a range of 6/100 mm to 20/100 mm, for example, about 8/100 mm.

The bristles may optionally be of sections and/or shapes that are identical, may be hollow or solid, may optionally be grooved, may optionally be tapered at one end, and may optionally include two or more of said features, if necessary or desired.

The bundle may comprise a mixture of bristles of different kinds, for example.

For example, the bristles may be made of one of the following materials: polyamide (PA), polyethylene terephthalate (PET), polytetrafluoroethylene (PTFE), polybutylene terephthalate (PBT), polypropylene (PP), polystyrene (PS), and polyoxymethylene (POM), this list not being limiting.

Exemplary embodiments of the invention may provide an applicator comprising a stem carrying a bundle of bristles, preferably of substantially flat cross-section, one side of the bundle including bristles that are relatively long and the other side including bristles that are relatively short, a difference in length between the long bristles and the short bristles exceeding 6 mm. For example, a length of the long bristles may be greater than 10 mm, and a length of the short bristles may be less than 6 mm. Free ends of the bristles of the bundle may form a bevel with an angle that lies in a range of 10° to 35°, for example.

Exemplary embodiments of the invention may provide a packaging and applicator device comprising an applicator, as defined above, and a receptacle in which the applicator may be fastened.

For example, the receptacle may contain a composition for applying to nails or skin, and that may be configured to contain pigments such as, for example, a white nail varnish.

The receptacle may be made of glass or any other material that is suitable for containing the composition.

Exemplary embodiments of the invention may provide a method of applying makeup, in which a line of composition is deposited on skin or nails using the tip of an applicator as defined above.

For example, the method may comprise a step consisting of marking the white of the nails using the tip of the applicator.

Exemplary embodiments of the invention may provide an applicator comprising a stem and a bundle of bristles at one end of the stem, the bundle including one end with a shape configured to form a tip that is used to deposit a line of composition. The shape of the end of the bundle may enable the tip to be spared by the composition tending to reach the end of the bundle by gravity when the applicator is held vertically after wiping the tip.

BRIEF DESCRIPTION OF THE DRAWINGS

Various details of the present invention may will be better understood on reading the following detailed description of non-limiting embodiments, and on examining the accompanying drawings, in which:

FIG. 1 is a diagrammatic view in elevation of an exemplary packaging and applicator device, the applicator being shown separate from the receptacle;

FIG. 2 is a diagrammatic longitudinal cross-sectional view of device of FIG. 1, with the applicator being in place on the receptacle;

FIG. 3 is a larger-scale view showing the stem of the applicator of FIG. 1 in isolation and in cross section taken along III-III in FIG. 1;

FIG. 4 is a cross-sectional view of the stem taken along IV-IV in FIG. 1;

FIG. 5 is a diagrammatic cross-sectional view taken along V-V in FIG. 1;

FIG. 6 is a side view along axis X;

FIG. 7 is a diagrammatic view in elevation of the bundle of bristles and the end of the stem carrying the bundle;

FIG. 8 illustrates use of the applicator for marking the white of the nails;

FIG. 9 is a view similar to FIG. 3 of another exemplary embodiment;

FIGS. 10 to 12 are views similar to FIG. 7 of other exemplary embodiments; and FIG. 13 illustrates the possibility of including a wiper in the neck.

DETAILED DESCRIPTION OF EMBODIMENTS

The exemplary packaging and applicator device 1 shown in FIGS. 1 and 2 comprises firstly a receptacle 3 containing a cosmetic composition V for applying to the nails, for example, a white pigmented varnish, and secondly an applicator 2 for applying the composition V and that is suitable for fastening onto the receptacle 3 when not in use, so as to close the receptacle in a sealed manner.

In the exemplary embodiment, the receptacle 3 may comprise a body 4 that is made of glass, and that is provided at a top thereof with a neck 5 that is threaded on the outside, and on which a closure element 6 may be screwed.

The applicator 2 may comprise a covering cap 7, in which the closure element 6 may be inserted, and a stem 8 of longitudinal axis Y. A top end of the stem 8 may include a tubular endpiece 9 that may be inserted into a housing 10 of a shape corresponding to the closure element 6.

The stem 8 may also include a truncated cone-shaped portion 12 that may be connected to a disk 13 that is extended upward by the endpiece 9.

The disk 13 may come to rest axially against a top end 15 of the neck 5 when the receptacle 3 is closed, as illustrated in FIG. 2, and may thus contribute to sealing the receptacle closed.

The receptacle 3 may contain a bead 17 that makes it possible to mix the composition V before use.

At a bottom end, the stem 8 may include a housing 20 that receives a bundle of bristles 21 forming a brush.

As illustrated in FIG. 3, the housing 20 may include a cross-section that is oblong in shape, for example, rectangular, and that is elongate along a major axis X perpendicular to the longitudinal axis Y.

As illustrated in FIG. 6, when observed along the axis X, the bundle of bristles may include a substantially straight end, for example.

In the exemplary embodiment, the bundle of bristles 21 may be constituted by a tuft of bristles that is folded in half and fastened to an end wall of the housing 20 by a staple 23, which may be oriented parallel to the axis X, for example.

The stem 8 may include a cross-section that is also oblong shaped, and that is elongate along the same major axis X, for example, with grooves 25 on two opposite main faces.

Around the housing 20, the stem 8 may include a thickness of material e that is variable, as illustrated.

Above the housing 20, the stem 8 may include a solid cross-section, as illustrated in FIG. 4.

The oblong shape of the housing 20 may impart a cross-section to the bundle of bristles 21 that is generally flat in shape, for example, substantially rectangular or oval, as illustrated in FIG. 5.

In the exemplary embodiment, each groove 25 may opens downward, substantially mid-way across the bundle of bristles 21, as illustrated in FIG. 7.

In FIG. 7, when the brush 21 is observed in a direction perpendicular to the axes X and Y, the brush 21 may include a generally beveled shape, with a tip 27 at a bottom end of the brush 21.

For example, an angle$\alpha$ at the tip of the bevel may lie in a range of 10° to 35°, and may be close to about 20°, for example.

In FIG. 7, the brush 21 may include an outline that widens from the stem 8. The tip 27 may be offset laterally relative to the longitudinal axis Y.

For example, a distance m measured along the longitudinal axis Y between the stem 8 and the tip of the bevel, defined by the longest bristles, may lie in a range of 10 mm to 20 mm, and may be close to 17 mm, for example.

For example, a distance n, also measured parallel to the longitudinal axis Y between the stem 8 and a top corner 30 of an end face 29, defined by the ends of the shortest bristles, may lie in a range of 5 mm to 10 mm, for example, less than 8 mm. An offset m-n preferably may be greater than or equal to 6 mm. In the exemplary embodiment, a length t of the substantially planar end face 29 may be greater than 6 mm, for example. A width w at a base of the bevel, that is, at a height of a corner 30, may lie in a range of 2 mm to 4 mm, for example.

Before mounting the applicator 2 in the receptacle 3, the brush 21 may preferably be stiffened, for example, via a composition that dissolves in the composition V. This makes it possible to avoid any bristles being damaged, and also makes it easier to insert the brush 21 through the neck 5 of the receptacle.

The applicator 2 may be used as follows.

After having mixed the composition V, for example, by shaking the device 1, the applicator 2 may be removed from the receptacle 3, and a user may wipe the brush against an edge of the neck 5.

When the applicator is held vertically, a drop G of composition V that tends to form, as illustrated by dashes in FIG. 7, remains at a distance from the tip 27.

The user may mark the white C of the nail with the tip 27, as illustrated in FIG. 8. For example, to deposit the composition, the user may use the bottom end of the end face 29 by bringing the end face 29 into contact with the nail, the stem being straight. Alternatively or additionally, the user may use a back 33 of the brush 21, the brush 21 being turned through 180°. The user may also use a side portion of the tip 27, or even use something other than the applicator, depending on the pattern to be marked.

The composition V that flows along the stem under the effect of gravity may stop substantially in a center of the end face 29 and may supply the tip 27 only when the brush is deformed by pressing against the nail, thereby enabling the user to deposit the composition evenly.

Various modifications may be applied to the embodiment described above.

For example, the stem 8 may be made without the grooves 25, as illustrated in FIG. 9. However, this may result in the makeup being applied less accurately.

The brush 21 may include present shapes other than the shape illustrated in FIG. 7. For example, the brush 21 may include a truncated or rounded tip 27, as illustrated in FIG. 12.

The end face 29 need not be substantially planar, but may be generally outwardly convex or concave, as illustrated in FIGS. 10 and 11. In such configurations, the angle a may be measured between the back 33 of the brush 21 and a tangent at the end face 29, at the tip 27, in the plane of the axes X and Y.

Various kinds of bristle may be used.

In the exemplary embodiments illustrated, bristles of circular solid section of 8/100 mm in diameter may be used. However, other bristles of different sections and/or of different sizes may be used. For example, the kind of bristles may be selected as a function of the kind of composition to be applied. A mixture of bristles may be used, where appropriate or desired. The bristles may be made of PA, PET, PTFE, PP, PS, POM, PBT, or other natural or synthetic materials.

The bristles may include ends that are tapered.

The neck of the receptacle may receive a wiper 40, as illustrated in FIG. 13.

Throughout the description, including in the claims, the expression "comprising a" should be understood as being synonymous with "comprising at least one," unless specified to the contrary.

The expression "lying in a range" should be construed as including the limits of the range.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An applicator comprising:

a stem having at least one groove and presenting a longitudinal axis;

a closure element configured to close a receptacle, said closure element being at a first end of the stem; and a bundle of bristles presenting a cross-section, taken perpendicular to the longitudinal axis of the stem, of generally flat shape and elongate along a major axis of the cross-section, said bundle of bristles being at a second end of the stem, remote from the first end of the stem, and comprising, when observed perpendicularly to the major axis, a beveled end with an angle at a tip of the bevel lying in a range of about 10° to about 35°, wherein the at least one groove on the stem opens substantially mid-way across the bundle of bristles.

2. An applicator according to claim 1, wherein the angle lies in a range of about 15° to about 30°.

3. An applicator according to claim 1, wherein the angle lies in a range of about 16° to about 23°.

4. An applicator according to claim 1, wherein, in cross-section, the bundle of bristles includes at least one of a substantially oval shape and a substantially rectangular shape.

5. An applicator according to claim 1, wherein the stem includes at least two longitudinal grooves opening substantially mid-way across the bundle of bristles, the longitudinal grooves being disposed opposite each other on the stem.

6. An applicator according to claim 1, wherein the stem comprises a housing including an oblong cross-section, the bundle of bristles being received in the housing.

7. An applicator according to claim 6, wherein the bundle of bristles comprises at least one tuft of bristles that is at least one of stapled in the housing and overmolded in the housing.

8. An applicator according to claim 1, wherein the stem comprises a housing including a rectangular cross section, the bundle of bristles being received in the housing.

9. An applicator according to claim 1, wherein the bundle of bristles comprises a mixture of bristles of at least one of different kinds and different shapes.

10. An applicator according to claim 1, wherein the bundle of bristles is stiffened.

11. An applicator according to claim 1, wherein bristles of the bundle of bristles include ends that are tapered by disk trimming.

12. An applicator according to claim 1, wherein the stem comprises an endpiece that is configured to secure the stem in the closure element.

13. An applicator according to claim 1, wherein the stem is rigid.

14. An applicator according to claim 1, wherein the tip is laterally offset relative to a longitudinal axis of the stem.

15. An applicator according to claim 1, wherein a maximum visible length of bristles of the bundle of bristles lies in a range of about 10 mm to about 20 mm.

16. An applicator according to claim 1, wherein the bundle of bristles includes a substantially planar end face.

17. An applicator according to claim 1, wherein the bundle of bristles includes a concave end face.

18. An applicator according to claim 1, wherein the bundle of bristles includes a convex end face.

19. An applicator according to claim 1, wherein the bundle of bristles is of substantially flat cross-section, one side of the bundle including bristles that are relatively long and an opposite side of the bundle including bristles that are relatively short, a difference in length between the long bristles and the short bristles exceeding 6 mm.

20. An applicator according to claim 19, wherein a length of the long bristles is greater than 10 mm.

21. An applicator according to claim 19, wherein a length of the short bristles is less than 8 mm.

22. A packaging and applicator device comprising:

an applicator as defined in claim 1; and a receptacle in which the applicator is configured to be fastened.

23. A device according to claim 22, wherein the receptacle contains a pigmented composition configured to apply to at least one of nails and skin.

24. A device according to claim 22, wherein the receptacle contains a nail varnish.

25. A device according to claim 22, wherein the receptacle comprises a wiper.

26. A method of applying makeup to nails, said method comprising:

providing an applicator as defined in claim 1; and marking the white of the nails using the tip of the applicator.

27. An applicator comprising:

a stem having at least one groove and presenting a longitudinal axis;

a closure element configured to close a receptacle, said closure element being at a first end of the stem; and a bundle of bristles presenting cross-section, taken perpendicular to the longitudinal axis of the stem, of flat shape and elongate along a major axis of the cross-section, said bundle of bristles being at a second end of the stem, remote from the first end of the stem, and comprising, when observed perpendicularly to the major axis, a beveled end with an angle at a tip of the bevel lying in a range of about 10° to about 35°, wherein, in cross-section, the bundle of bristles includes a generally flat shape and is wider than the at least one groove where the bundle of bristles meets the stem, and wherein the at least one groove on the stem opens substantially mid-way across the flat shape of the bundle of bristles.

* * * * *